US008933856B2

(12) United States Patent
Wang et al.

(10) Patent No.: US 8,933,856 B2
(45) Date of Patent: Jan. 13, 2015

(54) DUAL-POLARIZATION OMNIDIRECTIONAL ANTENNA

(75) Inventors: Zhuopeng Wang, Qingdao (CN); Hongquan Fu, Qingdao (CN); Changhong Xiao, Qingdao (CN)

(73) Assignee: Shandong University of Science and Technology, Qingdao, Shandong (CN)

( * ) Notice: Subject to any disclaimer, the term of this patent is extended or adjusted under 35 U.S.C. 154(b) by 388 days.

(21) Appl. No.: 13/390,333

(22) PCT Filed: Dec. 23, 2010

(86) PCT No.: PCT/CN2010/080188

§ 371 (c)(1), (2), (4) Date: Feb. 13, 2012

(87) PCT Pub. No.: WO2011/076135

PCT Pub. Date: Jun. 30, 2011

(65) Prior Publication Data

US 2012/0249392 A1 Oct. 4, 2012

(30) Foreign Application Priority Data

Dec. 25, 2009 (CN) ..... 2009 1 0249562

(51) Int. Cl.
*H01Q 19/10* (2006.01)
*H01Q 9/04* (2006.01)

(52) U.S. Cl.
CPC ..... *H01Q 9/0435* (2013.01); *H01Q 9/0457* (2013.01)
USPC ..... 343/834

(58) Field of Classification Search
USPC ..... 343/834
See application file for complete search history.

(56) References Cited

U.S. PATENT DOCUMENTS 5,519,406 A * 5/1996 Tsukamoto et al. ... 343/700 MS

* cited by examiner

*Primary Examiner* — Dameon E Levi
*Assistant Examiner* — Andrea Lindgren Baltzel

(57) ABSTRACT

A dual-polarization omnidirectional antenna includes a reflecting base plate, a radiating oscillator, outputting coaxial cables, RF connectors, a metallic supporting pillar and a T-shaped probe. The radiating oscillator has an upper layer provided with a one-to-two feed dividing network and a lower layer provided with a round patch; the T-shaped probe is welded with the round patch. A mixing ring is arranged on the reflecting base plate; two RF connectors are respectively connected with a first port and a second port of the mixing ring; an inner conductor of a first outputting coaxial cable has a first end connected with the feed dividing network and a second end connected with a third port of the mixing ring; an inner conductor of another outputting coaxial cable has a first end connected with the T-shaped probe and a second end connected with a fourth port of the mixing ring.

18 Claims, 4 Drawing Sheets

DUAL-POLARIZATION OMNIDIRECTIONAL ANTENNA

BACKGROUND OF THE PRESENT INVENTION

1. Field of Invention

The present invention relates to an antenna in a field of mobile communications, and more particularly to an antenna having al least two radiating patterns.

2. Description of Related Arts

A conventional dual-polarization omnidirectional antenna mainly adopts the combination of vertical polarization and horizontal polarization. Most of the conventional dual-polarization omnidirectional antennas accomplish omnidirectional beams by arranging several oscillators in a circle. Although the conventional technology of the dividing network has matured, the circular-polarization antenna usually has big volume, which complicates the structure of the antenna and leads to large difference in gains of the two polarizations. Therefore, the circular-polarization antenna is restricted in many application fields. Meanwhile, in the actual application, particularly in the field of mobile communications, the vertical-polarization and horizontal-polarization antenna is rarely used, while mostly an antenna polarized at ±45 degrees is used. For dual-polarization omnidirectional antennas, it is relatively difficult to accomplish a horizontal omnidirectional antenna, and thus it is more necessary to develop the dual-polarization omnidirectional antenna polarized at ±45 degrees.

SUMMARY OF THE PRESENT INVENTION

In order to meet the above requirements, an object of the present invention is to provide a dual-polarization omnidirectional antenna having a compact structure and two polarizations of balanced gains.

The dual-polarization omnidirectional antenna of the present invention comprises a radiating oscillator, a first outputting coaxial cable, a first RF connector, a second outputting coaxial cable, a second RF connector, a reflecting base plate, several metallic supporting pillars and a T-shaped probe, wherein the radiating oscillator comprises a two-layer copper-coated dielectric plate, an upper layer thereof has a one-to-two feed dividing network and a lower layer thereof has a round patch. An end of a first outputting end and an end of a second outputting end of the one-to-two feed dividing network are in open circuits. An outer circular edge of the round patch has a gap in a shape of a slot, wherein a first longitudinal gap and a second longitudinal gap locate at a same longitudinal axis, the first longitudinal gap and the first outputting end are vertical to each other, the second longitudinal gap and the second outputting end are vertical to each other, and a first transverse gap and a second transverse gap locate at a same transverse axis. The radiating oscillator is horizontally fixed on the reflecting base plate through the metallic supporting pillar. The T-shaped probe comprises a copper-coated dielectric plate which is vertically fixed between the reflecting base plate and the radiating oscillator. A first end of an inner conductor of the first outputting coaxial cable passes through the radiating oscillator to be connected to the one-to-two feed dividing network. A second end of the inner conductor of the first outputting coaxial cable is connected to the RF connector. An outer conductor of the first outputting coaxial cable and the round patch are welded together. The inner conductor of the second outputting coaxial cable has a first end connected to the T-shaped probe and a second end connected to the second RF connector. An outer conductor of the second outputting coaxial cable and the reflecting base plate are welded together.

For the dual-polarization omnidirectional antenna of the present invention, the T-shaped probe comprises the copper-coated dielectric plate, wherein the copper-coated dielectric plate of the T-shaped probe has a copper bar on an upper end thereof by which the copper-coated dielectric plate of the T-shaped probe is welded with the round patch.

For the dual-polarization omnidirectional antenna of the present invention, the T-shaped probe is replaced by a Γ-shaped probe.

For the dual-polarization omnidirectional antenna of the present invention, a diameter d of the round patch is larger than 0.75λ and smaller than 0.85λ and the first gap and the second gap respectively have a length L longer than 0.1λ and shorter than 0.15λ, wherein λ is a wavelength in the air corresponding with a central frequency of the antenna.

For the dual-polarization omnidirectional antenna of the present invention, a height h of the metallic supporting pillar is higher than 0.1λ and lower than 0.22λ.

For the dual-polarization omnidirectional antenna of the present invention, the diameter d of the round patch is equal to 0.8λ, and the length L of the first gap and the second gap is equal to 0.12λ.

For the dual-polarization omnidirectional antenna of the present invention, the height h of the metallic supporting pillar is equal to 0.15λ.

The dual-polarization omnidirectional antenna of the present invention further comprises a mixing ring which comprises a copper-coated dielectric plate and is fixed on the reflecting base plate. The first RF connector and the second RF connector are respectively connected to the round patch and the T-shaped probe by the mixing ring. A ring and four radial bar ports having an outputting impedance of 50 ohms and connected to the ring are provided on the mixing ring, wherein a first port, a third port, a second port and a fourth port are successively arranged on a left semi-circumference or a right semi-circumference of the ring. The first outputting coaxial cable is replaced by a third outputting coaxial cable and a fifth outputting coaxial cable and the second outputting coaxial cable is replaced by a fourth outputting coaxial cable and a sixth outputting coaxial cable. A first end of an inner conductor of the third outputting coaxial cable passes through the radiating oscillator to be connected to an inputting end of the feed dividing network. A second end of the inner conductor of the third outputting coaxial cable is connected to the third port. An outer conductor of the third outputting coaxial cable is welded with the round patch; the third outputting coaxial cable is connected to the first port through the fifth outputting coaxial cable; a first end of an inner conductor of the fourth outputting coaxial cable is connected to the T-shaped probe and a second end of the inner conductor of the fourth outputting coaxial cable is connected to the fourth port. The fourth RF connector is connected to the second port by the sixth outputting coaxial cable. The fourth outputting coaxial cable, the fifth outputting coaxial cable and the sixth outputting coaxial cable respectively have an outer conductor welded with the reflecting base plate.

The dual-polarization omnidirectional antenna of the present invention has following advantages. A radiating oscillator, a reflecting base plate, a metallic supporting pillar, a T-shaped probe, outputting coaxial cables and a mixing ring further provided in a preferred embodiment of the present invention form a dual-polarization omnidirectional antenna polarized at ±45 degrees, under the condition of guaranteeing basic electrical performance, which greatly simplifies a structure of an antenna; meanwhile, the present invention adopts a structure of a round patch of a radiating oscillator, which effectively balances a performance of two polarizations to accomplish basically equal gains of the two polarizations.

DETAILED DESCRIPTION OF THE PREFERRED EMBODIMENT

The present invention adopts a form that two polarizations share a radiant round patch. In order to further illustrate a dual-polarization omnidirectional antenna of the present invention, more detailed description combined with preferred embodiments is following.

A First Preferred Embodiment

Figure 1:
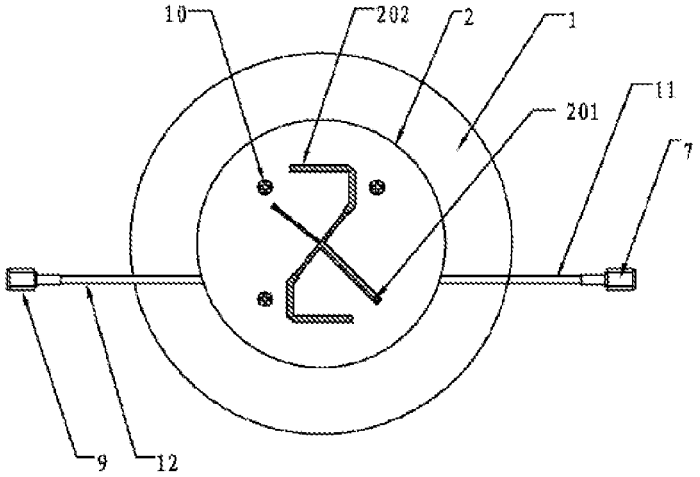
FIG. 1 is a top view of a dual-polarization omnidirectional antenna according to a first preferred embodiment of the present invention.
Figure 2:
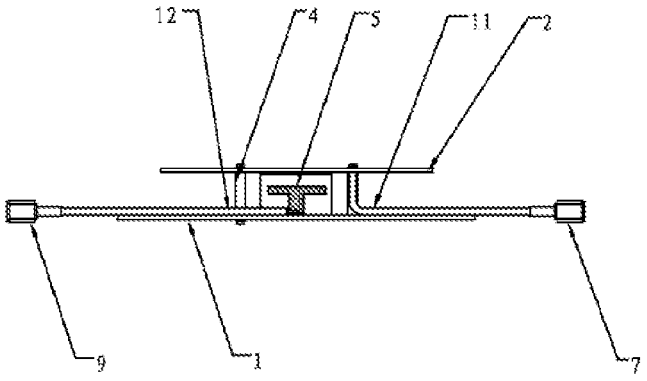
FIG. 2 is a front view of the dual-polarization omnidirectional antenna according to the first preferred embodiment of the present invention.

Referring to FIG. 1 and FIG. 2 of the drawings, the dual-polarization omnidirectional antenna comprises a reflecting base plate 1, a radiating oscillator 2, a metallic supporting pillar 4, a T-shaped probe 5, a first RF connector 7, a second RF connector 9, a first outputting coaxial cable 11 and a second outputting coaxial cable 12.

Figure 3A:
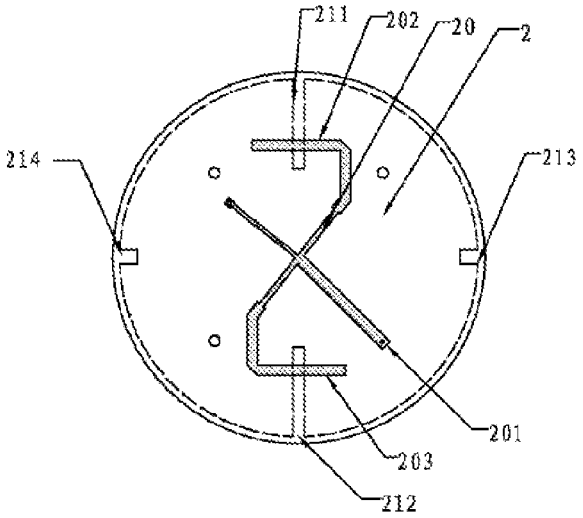
FIG. 3*a* is a top view of a radiating oscillator.
Figure 3B:
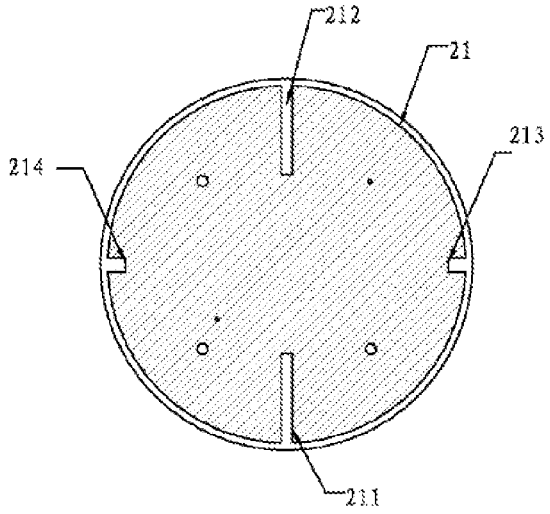
FIG. 3*b* is a bottom view of the radiating oscillator.

Referring to FIG. 3*a* and FIG. 3*b* of the drawings, the radiating oscillator 2 comprises a two-side copper-coated dielectric plate. An upper layer of the two-sides copper-coated dielectric plate of the radiating oscillator 2 is etched into a one-to-two feed dividing network 20 which is accomplished by a conventional art; a lower layer of the two-sides copper-coated dielectric plate of the radiating oscillator 2 is etched into a round patch 21 having four gaps, wherein a diameter d of the round patch 21 is equal to 0.8λ (λ is a wavelength in the air corresponding with a central frequency of the working antenna), a height h of the metallic supporting pillar 4 is equal to 0.15λ, wherein d ranges from 0.75λ to 0.85λ and h ranges from 0.1λ and 0.22λ. The metallic supporting pillar 4 is not only for supporting the round patch 21, but also for expanding frequency bandwidth of the dual-polarization omnidirectional antenna. However, in order to keep an ovality of the dual-polarization omnidirectional antenna, it is necessary to reduce adjustment to the metallic supporting pillar 4.

A first end of an inner conductor of the first outputting coaxial cable 11 passes through the copper-coated dielectric plate of the radiating oscillator 2 to be connected to an inputting end 201 of the feed dividing network 20, and an outer conductor of the first outputting coaxial cable 11 is welded with the round patch 21; a second end of the first outputting coaxial cable 11 is connected to the first RF connector 7.

The radiating oscillator 2 is supported by three identical metallic supporting pillars 4, which is fixed on the reflecting base plate 1 with screws 10. The T-shaped probe 5 comprises a copper-coated dielectric plate which locates between the reflecting base plate 1 and the radiating oscillator 2. A copper bar 50 is provided on an upper end of the T-shaped probe 5. An upper end of the copper-coated dielectric plate of the T-shaped probe 5 is fixed by welding with the round patch 21 by the copper bar 50. The T-shaped probe 5 is connected to a first end of an inner conductor of the second outputting coaxial cable 12. A second end of the inner conductor of the second outputting coaxial cable 12 is connected to the second RF connector 9. An outer conductor of the second outputting coaxial cable 12 is welded with the reflecting base plate 1.

An outer circular edge of the round patch 21 has a plurality of slot-shaped gaps from 211 to 214, wherein the first longitudinal gap 211 and the second longitudinal gap 212 are in a same longitudinal axis, the first longitudinal gap 211 is vertical with a first outputting end 202, the second longitudinal gap 212 is vertical with a second outputting end 203, and the first transverse gap 213 and the second transverse gap 214 are in a same transverse axis. The feed dividing network 20 has an end of the first outputting end 202 and an end of the second outputting end 203 in open circuit.

The first outputting end 202 of the feed dividing network 20 activates the relatively narrow first gap 211 on the round patch 21. The second outputting end 203 of the feed dividing network 20 activates the relatively narrow second gap 212 on the round patch 21. The first gap 211 and the second gap 212 respectively have a length L equal to 0.12λ. And L ranges from 0.1λ to 0.15λ. A return loss of the dual-polarization dielectric plate is improved by adjusting the length of the first gap 211 and the second gap 212. A common length of the first transverse gap 213 and the second transverse gap 214 is 0.02λ and is adjusted when necessary in order to improve an ovality of beams of the dual-polarization omnidirectional antenna.

A vertical or horizontal dual-polarization omnidirectional antenna is provided in the first preferred embodiment.

A Second Preferred Embodiment

Based on the first preferred embodiment, an additional two-polarization omnidirectional antenna comprises a mixing ring 3 of 3 dB which comprises a copper-coated dielectric plate and is fixed on a reflecting base plate 1 by several additional screws 13.

Figure 6:
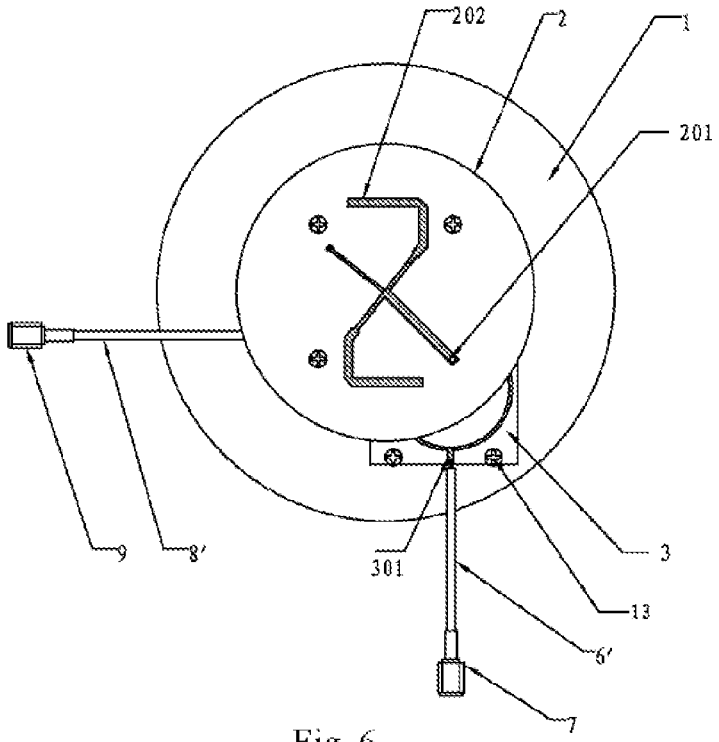
FIG. 6 is a top view of a dual-polarization omnidirectional antenna according to a second preferred embodiment of the present invention.
Figure 7:
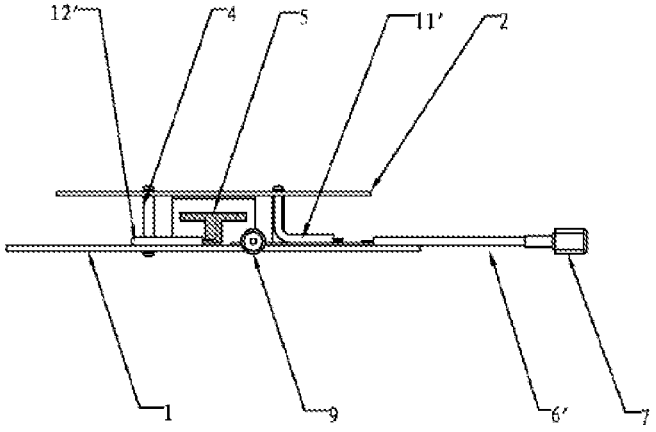
FIG. 7 is a left view of the dual-polarization omnidirectional antenna according to the second preferred embodiment of the present invention.

Referring to FIG. 6 and FIG. 7 of the drawings, the additional dual-polarization omnidirectional antenna comprises the reflecting base plate 1, a radiating oscillator 2, a metallic supporting pillar 4, a T-shaped probe 5, a first RF connector 7, a second RF connector 9, a third outputting coaxial cable 11', a fourth outputting coaxial cable 12', a fifth outputting coaxial cable 6' and a sixth outputting coaxial cable 8'.

Figure 4:
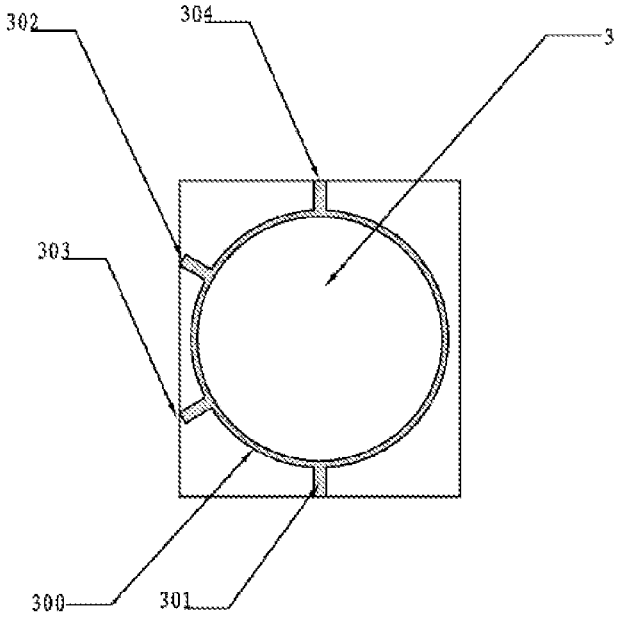
FIG. 4 is a sketch view of a mixing ring.

Referring to FIG. 4, the mixing ring 3 has a ring 300 and four radial bar ports from 301 to 304 which respectively have an outputting impedance of 50 ohms and are connected to the ring 300, wherein the first port 301, the third port 303, the second port 302 and the fourth port 304 are successively arranged on a left semi-circumstance or a right semi-circumstance of the ring 300. There is a phase difference of 90 degrees respectively between the first port 301 and the third port 303, between the third port 303 and the second port 302, and between the second port 302 and the fourth port 304. The phase difference between the first port 301 and the fourth port 304 is 270 degrees. All of the four ports have same amplitude. Therefore, a horizontally polarized signal inputted by the second port 302 and a vertically polarized signal inputted by the fourth port 304 are combined as vectors through the mixing ring 3. Thus signals at the first port 301 turn out to be polarized at −45 degrees and signals at the second port 302 turn out to be polarized at +45 degrees.

A first end of an inner conductor of the third outputting coaxial cable 11' passes through a copper-coated dielectric plate of the radiating oscillator 2 to be connected to an outputting end 201 of a feed dividing network 20. An outer conductor of the third outputting coaxial cable 11' is welded with the round patch 21. A second end of the inner conductor of the third outputting coaxial cable 11' is connected to the third port 303. The first RF connector 7 is connected to the first port 301 through an inner conductor of the fifth outputting coaxial cable 6'.

A first end of an inner conductor of the fourth outputting coaxial cable 12' is connected to the T-shaped probe 5. A second end of the inner conductor of the fourth outputting coaxial cable 12' is connected to the fourth port 304. The second RF connector 9 is connected to the second port 302 through an inner conductor of the sixth outputting coaxial cable 8' so as to form two paths of outputting ports of the additional dual-polarization omnidirectional antenna. The fourth outputting coaxial cable 12', the fifth outputting coaxial cable 6' and the sixth outputting coaxial cable 8' respectively have an outer conductor welded with the reflecting base plate 1.

Here leaves out other parts embodied as the first preferred embodiment does.

The additional dual-polarization omnidirectional antenna polarized at ±45 degrees is provided in the second preferred embodiment, which works in a way that a first end of an outputting coaxial cable is connected to a port of a mixing ring and a second end of the outputting coaxial cable is connected to a radiating oscillator, so as to activate two relatively narrow gaps to produce horizontally polarized omnidirectional beams; that a first end of another outputting coaxial cable is connected to another port of the mixing ring and a second end of the another outputting coaxial cable is connected to a T-shaped probe which activates a round patch so as to produce vertically polarized omnidirectional beams. A phase difference between the two ports of the mixing ring connected to the two outputting coaxial cables is 180 degrees. Vertically polarized signals and horizontally polarized signals are combined as space vectors through the mixing ring and outputted to be polarized at −45 degrees or at +45 degrees, which effectively balances performance of the additional dual-polarization omnidirectional antenna and produces basically equal gains of the two polarizations.

Figure 5A:
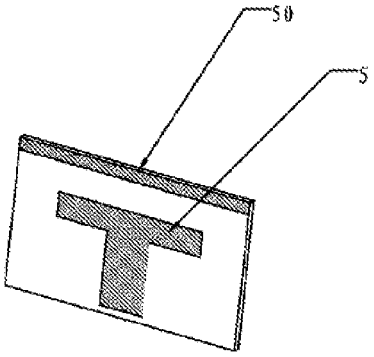
FIG. 5*a* is a sketch view of a T-shaped probe.
Figure 5B:
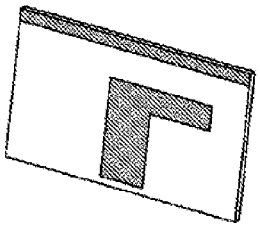
FIG. 5*b* is a sketch view of a Γ-shaped probe.

In other preferred embodiments according to the present invention, referring to FIG. 5*a* and FIG. 5*b* of the drawings, the T-shaped probe is replaced by a Γ-shaped probe. The Γ-shaped probe also comprises a copper-coated dielectric plate which has a copper bar on an upper end thereof and is welded with the round patch through the copper bar. By using the Γ-shaped probe, an impedance bandwidth of the dual-polarization omnidirectional antenna is effectively expanded.

The dual-polarization omnidirectional antenna of the present invention has following beneficial results that greatly simplifies a structure thereof and balances the performance thereof, in such a manner that the gains of the two polarizations are basically equal. The present invention is applied in a frequency range between 0.5 GHz and 10 GHz, including GSM (from 806 MHz to 960 MHz), UMTS (from 1920 MHz to 2170 MHz), Wimax (from 2.3 GHz to 2.7 GHz), and Wi-Fi (from 5.1 GHz to 5.9 GHz) and so on.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

INDUSTRIAL UTILITY

All components of the dual-polarization omnidirectional antenna of the present invention are massively produced by conventional mature technology. Designed technological results are also reaped in actual application. Thus the present invention has a large market potential and a strong industrial utility.

What is claimed is:

1. A dual-polarization omnidirectional antenna, comprising:

a radiating oscillator, a first outputting coaxial cable, a first RF connector, a second outputting coaxial cable and a second RF connector, wherein a reflecting base plate, multiple metallic supporting pillars and a probe are further comprised, wherein said radiating oscillator comprises a dielectric plate coated with two layers of copper whose upper layer has a one-to-two feed dividing network and whose lower layer has a round patch;

said feed dividing network has an end of a first outputting end and an end of a second outputting end in open circuit;

an outer circular edge of said round patch has multiple slot-shaped gaps, wherein a first longitudinal gap and a second longitudinal gap are on a same longitudinal axis, said first longitudinal gap and said first outputting end are aligned vertically to each other, said second longitudinal gap and said second outputting end are aligned vertically to each other, and a first transverse gap and a second transverse gap are on a same transverse axis;

said radiating oscillator is horizontally fixed on said reflecting base plate through said metallic supporting pillars;

said probe is fixed between said reflecting base plate and said radiating oscillator;

a first end of an inner conductor of said first outputting coaxial cable and an inputting end of said feed dividing network are connected with each other and a second end of said inner conductor of said first outputting coaxial cable is connected to said first RF connector;

an outer conductor of said first outputting coaxial cable is welded with said round patch; an inner conductor of said second outputting coaxial cable has a first end connected to said probe and a second end connected to said second RF connector;

an outer conductor of said second outputting coaxial cable is welded with said reflecting base plate.

2. The dual-polarization omnidirectional antenna, as recited in claim 1, wherein said probe is T-shaped.

3. The dual-polarization omnidirectional antenna, as recited in claim 1, wherein said probe is Γ-shaped.

4. The dual-polarization omnidirectional antenna, as recited in claim 2, wherein said T-shaped probe comprises a dielectric plate coated with two layers of copper having a copper bar provided on an upper end thereof and through said copper bar the copper-coated dielectric plate is welded with said round patch.

5. The dual-polarization omnidirectional antenna, as recited in claim 3, wherein said Γ-shaped probe comprises a dielectric plate coated with two layers of copper having a copper bar provided on an upper end thereof and through said copper bar the copper-coated dielectric plate is welded with said round patch.

6. The dual-polarization omnidirectional antenna, as recited in claim 1, wherein said round patch has a diameter d ranging from 0.75λ to 0.85λ and said first longitudinal gap and said second longitudinal gap respectively have a length L ranging from 0.1λ to 0.15λ, wherein λ is a wavelength in the air corresponding with a central frequency of said dual-polarization omnidirectional antenna.

7. The dual-polarization omnidirectional antenna, as recited in claim 6, wherein a metallic supporting pillar has a height h ranging from 0.1λ to 0.22λ.

8. The dual-polarization omnidirectional antenna, as recited in claim 7, wherein said round patch has a diameter d of 0.8λ and said first longitudinal gap and said second longitudinal gap respectively have a length L of 0.12λ.

9. The dual-polarization omnidirectional antenna, as recited in claim 8, wherein said metallic supporting pillar has a height h of 0.15λ.

10. A dual-polarization omnidirectional antenna, comprising:

a radiating oscillator, a third outputting coaxial cable, a fourth outputting coaxial cable, a fifth outputting coaxial cable, a sixth outputting coaxial cable, a first RF connector, a second RF connector, a reflecting base plate, multiple metallic supporting pillars and a probe, wherein said radiating oscillator comprises a dielectric plate coated with two layers of copper whose upper layer has a one-to-two feed dividing network and whose lower layer has a round patch;

said feed dividing network has an end of a first outputting end and an end of a second outputting end in open circuit;

an outer circular edge of said round patch has multiple slot-shaped gaps, wherein a first longitudinal gap and a second longitudinal gap are on a same longitudinal axis, said first longitudinal gap and said first outputting end are aligned vertically to each other, said second longitudinal gap and said second outputting end are aligned vertically to each other, and a first transverse gap and a second transverse gap are on a same transverse axis;

said radiating oscillator is horizontally fixed on said reflecting base plate through a metallic supporting pillar;

said probe is fixed between said reflecting base plate and said radiating oscillator, wherein said dual-polarization omnidirectional antenna further comprises a mixing ring comprising a dielectric plate coated with two layers of copper arranged on said reflecting base plate, wherein said first RF connector and said second RF connector are respectively connected to said round patch and said probe through said mixing ring;

a ring and four ports respectively having an outputting impedance of 50 ohms and connected to said ring are provided on the mixing ring, wherein a first port, a second port, a third port, and a fourth port are successively arranged on a left half or a right half of said ring;

an inner conductor of said third outputting coaxial cable has a first end passing through the dielectric plate coated with two layers of copper of said radiating oscillator to be connected to a first inputting end of said feed dividing network, and a second inputting end connected to said third port;

an outer conductor of said third outputting coaxial cable is welded with said round patch;

said first RF connector is connected to said first port through said fifth outputting coaxial cable;

an inner conductor of said fourth outputting coaxial cable has a first end connected to said probe and a second end connected to said fourth port;

said second RF connector is connected to said second port through said sixth outputting coaxial cable;

said fourth outputting coaxial cable, said fifth outputting coaxial cable and said sixth outputting coaxial cable respectively have an outer conductor welded with said reflecting base plate.

11. The dual-polarization omnidirectional antenna, as recited in claim 10, wherein said probe is T-shaped.

12. The dual-polarization omnidirectional antenna, as recited in claim 10, wherein said probe is Γ-shaped.

13. The dual-polarization omnidirectional antenna, as recited in claim 11, wherein said T-shaped probe comprises a dielectric plate coated with two layers of copper having a copper bar provided on an upper end thereof and through said copper bar the copper-coated dielectric plate is welded with said round patch.

14. The dual-polarization omnidirectional antenna, as recited in claim 12, wherein said Γ-shaped probe comprises a dielectric plate coated with two layers of copper having a copper bar provided on an upper end thereof and through said copper bar the copper-coated dielectric plate is welded with said round patch.

15. The dual-polarization omnidirectional antenna, as recited in claim 10, wherein said round patch has a diameter d ranging from 0.75λ to 0.85λ and said first longitudinal gap and said second longitudinal gap respectively have a length L ranging from 0.1λ to 0.15λ, wherein λ is a wavelength in the air corresponding with a central frequency of said dual-polarization omnidirectional antenna.

16. The dual-polarization omnidirectional antenna, as recited in claim 15, wherein a metallic supporting pillar has a height h ranging from 0.1λ to 0.22λ.

17. The dual-polarization omnidirectional antenna, as recited in claim 16, wherein said round patch has a diameter d of 0.8λ and said first longitudinal gap and said second longitudinal gap respectively have a length L of 0.12λ.

18. The dual-polarization omnidirectional antenna, as recited in claim 17, wherein said metallic supporting pillar has a height h of 0.15λ.

* * * * *